US008534089B2

(12) United States Patent
An et al.

(10) Patent No.: US 8,534,089 B2
(45) Date of Patent: Sep. 17, 2013

(54) ICE MAKER AND REFRIGERATOR HAVING THE SAME

(75) Inventors: Jae Koog An, Gwangju (KR); Jong Yeob Kim, Gwangju (KR); Young Gwi Park, Gwangju (KR); Sang Min Park, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 795 days.

(21) Appl. No.: 12/314,339

(22) Filed: Dec. 8, 2008

(65) Prior Publication Data

US 2009/0308095 A1 Dec. 17, 2009

(30) Foreign Application Priority Data

Jun. 13, 2008 (KR) ..... 10-2008-0055627
Aug. 4, 2008 (KR) ..... 10-2008-0076040

(51) Int. Cl.

| | |
|---|---|
| ***F25C 5/08*** | (2006.01) |
| ***F25C 5/18*** | (2006.01) |
| ***F25C 1/00*** | (2006.01) |
| ***F25D 11/02*** | (2006.01) |
| ***F25D 17/02*** | (2006.01) |

(52) U.S. Cl.
USPC ..... 62/351; 62/334; 62/344; 62/348; 62/66; 62/188

(58) Field of Classification Search
USPC ..... 62/66, 188, 233, 137, 340, 135, 71, 62/334
See application file for complete search history.

(56) References Cited

U.S. PATENT DOCUMENTS

| | | | | | |
|---|---|---|---|---|---|
| 3,059,445 | A | * | 10/1962 | Kniffin | 62/135 |
| 3,362,182 | A | * | 1/1968 | Walker | 62/137 |
| 4,264,089 | A | * | 4/1981 | Maekawa et al. | 280/803 |
| 5,160,094 | A | * | 11/1992 | Willis et al. | 62/137 |
| 6,148,624 | A | * | 11/2000 | Bishop et al. | 62/137 |
| 6,915,644 | B2 | * | 7/2005 | Pohl et al. | 62/71 |
| 2002/0083726 | A1 | * | 7/2002 | Kim et al. | 62/137 |
| 2005/0183441 | A1 | * | 8/2005 | Lee et al. | 62/340 |

FOREIGN PATENT DOCUMENTS

KR 20-0180229 2/2000

* cited by examiner

*Primary Examiner* — Khoa Huynh
*Assistant Examiner* — Timothy K Trieu
(74) *Attorney, Agent, or Firm* — Staas & Halsey LLP

(57) ABSTRACT

Disclosed are an ice maker and a refrigerator having the same. The refrigerator includes a storage compartment, a storage compartment door for opening/closing the storage compartment, and an ice maker including an ice making tray for producing pieces of ice, and a water dispense cup for dispensing water supplied from a water supply pipe to the ice making tray. A water guide section is formed in the water dispense cup to guide the water, which is supplied from the water supply pipe, to a region below the water supply pipe so that ice pieces are prevented from being accumulated in the water dispense cup.

12 Claims, 7 Drawing Sheets

ICE MAKER AND REFRIGERATOR HAVING THE SAME

CROSS-REFERENCE TO RELATED APPLICATIONS

This application claims the priority benefit of Korean Patent Application No. 10-2008-0055627 filed on Jun. 13, 2008, in the Korean Intellectual Property Office, the disclosure of which is incorporated herein by reference, and this application claims the priority benefit of Korean Application No. 10-2008-0076040 filed on Aug. 4, 2008, in the Korean Intellectual Property Office, the disclosure of which is incorporated herein by reference.

BACKGROUND

1. Field

The present invention relates to an ice maker of a refrigerator. More particularly, the present invention relates to a water dispense cup for dispensing water to an ice making tray having ice making cells for producing pieces of ice.

2. Description of the Related Art

In general, a refrigerator includes a body having a refrigerating compartment and a freezing compartment. A compressor and a heat exchanger are installed at a rear portion of the body to compress refrigerant and to produce cold air, respectively. The cold air produced by the heat exchanger is introduced into the refrigerating compartment or the freezing compartment by a fan and the temperature of cold air may rise while circulating through the refrigerating compartment or the freezing compartment. Then, the air having the high temperature is heat-exchanged through the heat exchanger, so that the cold air can be introduced again into the refrigerating compartment or the freezing compartment, thereby keeping foodstuffs stored in the refrigerating compartment or the freezing compartment in a fresh state.

An ice maker is installed in the freezing compartment of the refrigerator and water is automatically dispensed to an ice making tray of the ice maker. If the water is frozen into pieces of ice, the ice pieces are automatically separated from the ice making tray and are stored in an ice storage container. Thus, users can obtain the ice pieces without additionally controlling the refrigerator to make pieces of ice, so that the ice maker is extensively used in these days.

The ice maker receives the water from a water dispense cup. The water dispense cup is made from plastic material and is coupled with the ice making tray. The water dispense cup is formed with a water path for dispensing the water to the ice making tray. In addition, water is supplied to the water dispense cup through a water supply pipe, which is disposed above the water dispense cup and connected to a water source at the outside of the refrigerator.

SUMMARY

Accordingly, it is an aspect of the present invention to provide an ice maker of a refrigerator.

Additional aspects, features, and/or advantages of the invention will be set forth in part in the description which follows and, in part, will be apparent from the description, or may be learned by practice of the invention.

According to an aspect of the present invention, there is provided a refrigerator including a storage compartment, a storage compartment door to open/close the storage compartment, and an ice maker including an ice making tray to produce ice pieces, and a water dispense cup to dispense water supplied from a water supply pipe to the ice making tray, wherein a water guide section is formed in the water dispense cup to guide the water, which is supplied from the water supply pipe, to a region below the water supply pipe.

The ice maker further includes a heater to heat the ice making tray.

The ice making tray and the water dispense cup include metal having superior heat conductivity.

The ice making tray is integrally formed with the water dispense cup.

The ice maker heats the water dispense cup by using heat of the heater that is operated when ice pieces are separated from the ice making tray.

The water guide section includes a first inclination surface, which is inclined to guide the water supplied from the water supply pipe toward the region below the water supply pipe, and a second inclination surface, which is inclined to allow the water introduced through the first inclination surface to be directed to a water outlet port of the water dispense cup.

The water guide section may include a first inclination surface, which is inclined to guide the water supplied from the water supply pipe toward the region below the water supply pipe, a second inclination surface, which is inclined to allow the water introduced through the first inclination surface to be directed toward a communication path, and third inclination surface, which is inclined from a rear portion of the water dispense cup toward a water outlet port of the water dispense cup to allow water supplied to the second inclination surface to be directed toward the water outlet port of the water dispense cup.

According to another aspect, there is provided an ice maker including an ice making tray to produce ice pieces, and a water dispense cup to dispense water to the ice making tray, wherein a water guide section is formed in the water dispense cup to guide the water, which is supplied from a water supply pipe, to a region below the water supply pipe.

The ice maker further includes a heater for heating the ice making tray.

The ice making tray and the water dispense cup include metal having superior heat conductivity and the ice making tray is integrally formed with the water dispense cup.

The water guide section includes a first inclination surface, which is inclined to guide the water supplied from the water supply pipe toward the region below the water supply pipe, and a second inclination surface, which is inclined to allow the water introduced through the first inclination surface to be directed to a water outlet port of the water dispense cup.

The ice maker heats the water dispense cup by using heat of the heater that is operated when ice pieces are separated from the ice making tray.

The water guide section may include a first inclination surface, which is inclined to guide the water supplied from the water supply pipe toward the region below the water supply pipe, a second inclination surface, which is inclined to allow the water introduced through the first inclination surface to be directed toward a communication path, and third inclination surface, which is inclined from a rear portion of the water dispense cup toward a water outlet port of the water dispense cup to allow water supplied to the second inclination surface to be directed toward the water outlet port of the water dispense cup.

According to still another aspect of the present invention, there is provided a refrigerator including a storage compartment, a storage compartment door to open/close the storage compartment, a water supply pipe protruding from the storage compartment door, and an ice maker including an ice making tray including metal having superior heat conductivity, a heater to heat the ice making tray, and a water dispense cup to dispense water supplied from the water supply pipe to the ice making tray, wherein the water dispense cup includes metal having superior heat conductivity, and a water guide section is formed in the water dispense cup to guide the water, which is supplied from the water supply pipe, to a region below the water supply pipe.

The ice making tray is integrally formed with the water dispense cup.

The water guide section may include a first inclination surface, which is inclined to guide the water supplied from the water supply pipe toward the region below the water supply pipe, a second inclination surface, which is inclined to allow the water introduced through the first inclination surface to be directed toward a communication path, and third inclination surface, which is inclined from a rear portion of the water dispense cup toward a water outlet port of the water dispense cup to allow water supplied to the second inclination surface to be directed toward the water outlet port of the water dispense cup.

BRIEF DESCRIPTION OF THE DRAWINGS

These and/or other aspects, features, and advantages of the invention will become apparent and more readily appreciated from the following description of exemplary embodiments, taken in conjunction with the accompanying drawings of which.

DETAILED DESCRIPTION OF EMBODIMENTS

Figure 1:
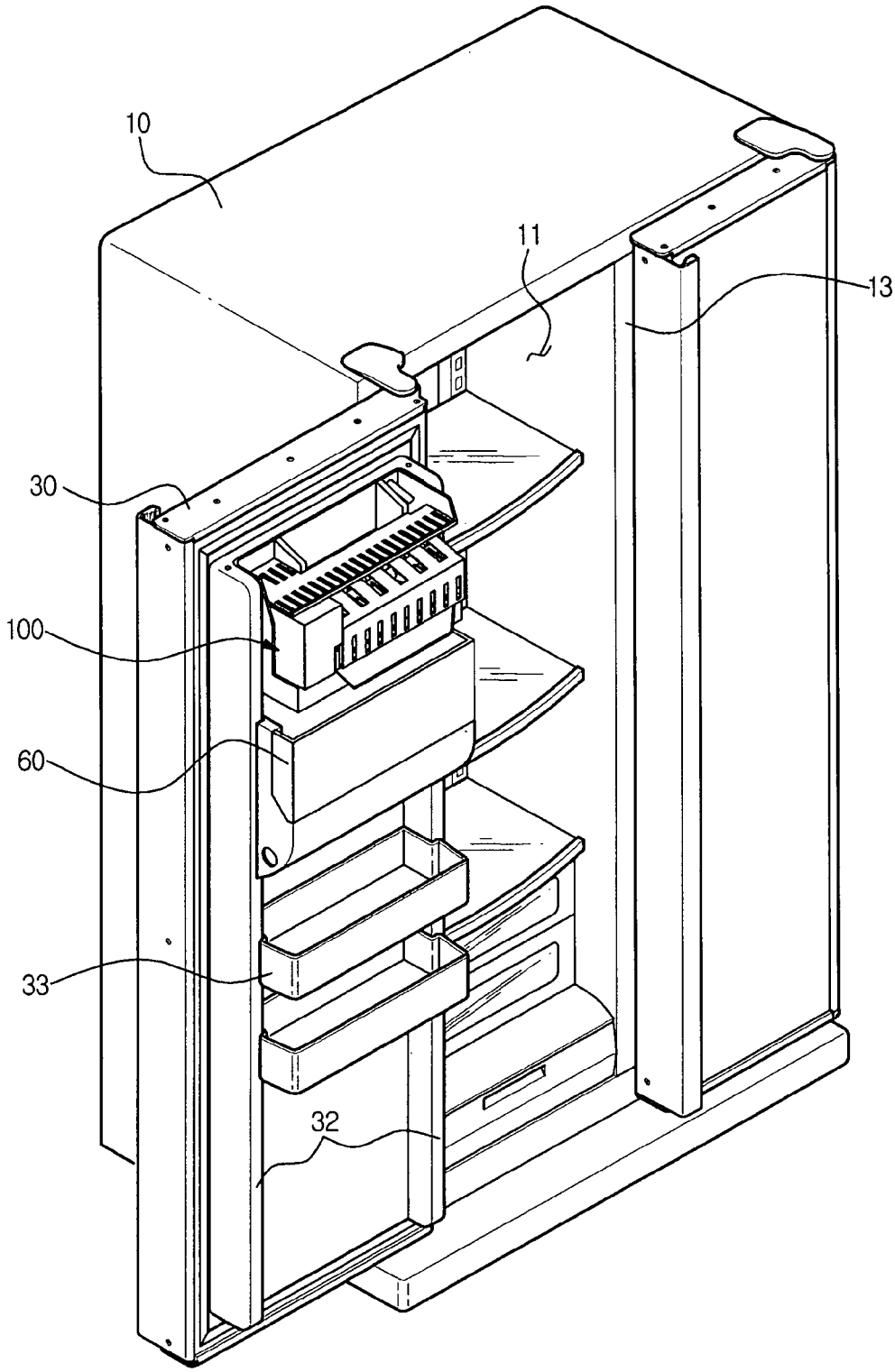
FIG. 1 is a perspective view schematically showing a refrigerator according to an exemplary embodiment of the present invention.

Reference will now be made in detail to exemplary embodiments of the present invention, examples of which are illustrated in the accompanying drawings, wherein like reference numerals refer to the like elements. Exemplary embodiments are described below to explain the present invention by referring to the figures.

Exemplary embodiments of the present invention provide an ice maker and a refrigerator having the same, capable of preventing ice or pieces of ice from being accumulated in a water dispense cup due to the drop of water remaining in a water supply pipe into the water dispense cup after the water has been supplied into the ice maker.

Referring to FIG. 1, a refrigerator according to an exemplary embodiment of the present invention includes a refrigerator body 10 having a storage compartment 11 therein. A front part of the refrigerator body 10 is open. The storage compartment 11 formed in the refrigerator body 10 is divided into a freezing compartment and a refrigerating compartment by an intermediate wall 13.

In addition, a storage compartment door 30 is installed at the front part of the refrigerator body 10 to open/close the storage compartment 11.

A pair of liners 32 are longitudinally installed at both sides of the inner wall of the storage compartment door 30 such that a plurality of door guards 33 can be installed between the liners 32 to store foodstuffs.

An ice maker 100 is installed between a pair of liners 32, which are provided at an upper portion of the storage compartment door 30, in order to make pieces of ice. An ice storage container 60 is positioned below the ice maker 100. The ice pieces made by the ice maker 100 are dropped into the ice storage container 60 and then transferred to a dispenser (not shown) by an ice convey device.

Figure 2:
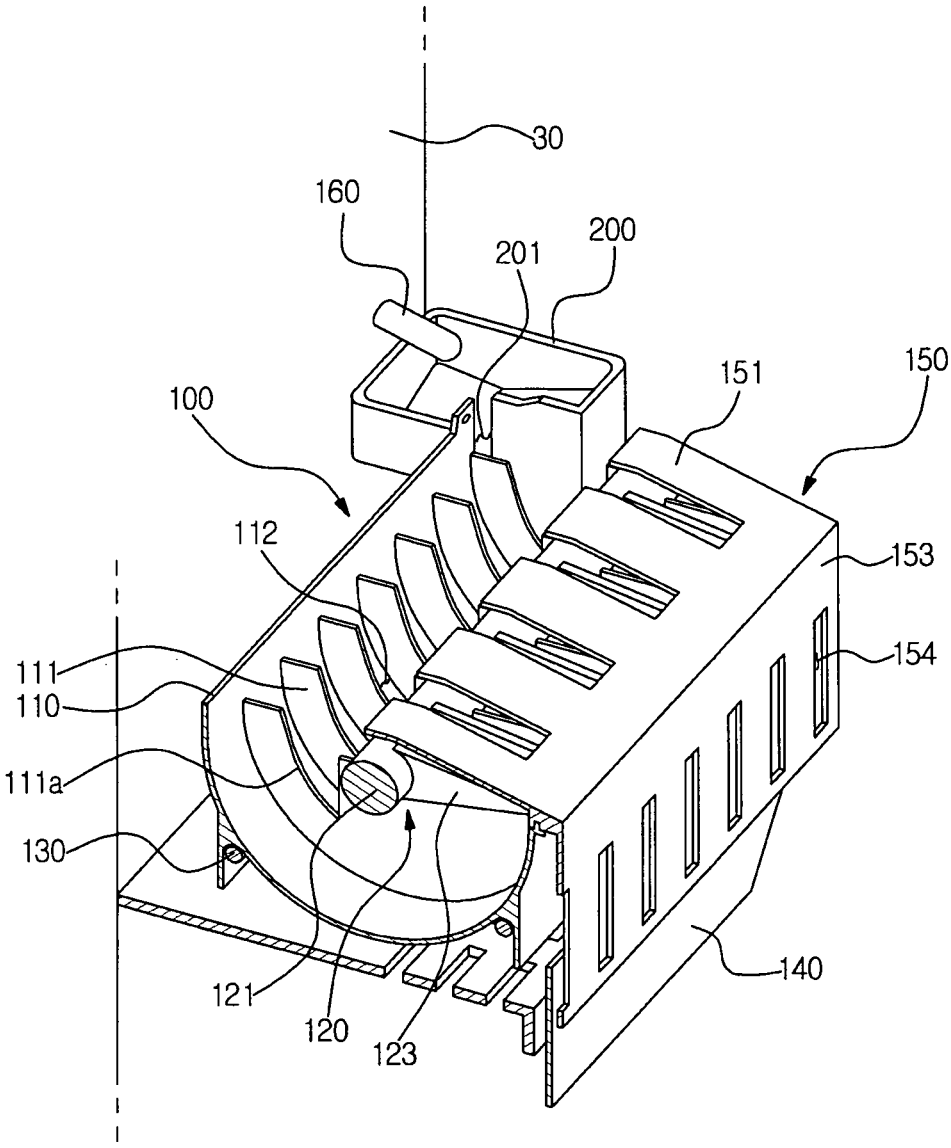
FIG. 2 is a perspective view schematically showing an ice maker according to an exemplary embodiment of the present invention.

As shown in FIG. 2, the ice maker 100 includes an ice making tray 110 for producing the ice pieces. The ice making tray 110 is made from a metal having superior heat conductivity, such as aluminum, and has a semi-circular cylindrical shape having a semi-circular section.

Ice making cells 112 having semi-circular shapes are provided between partition walls 111 provided in the ice making container 110. Water supplied to the ice making cell 112 is introduced into adjacent ice making cells 112 through a water path 111*a*.

An ejector 120 is provided at an upper portion of the partition walls 111. The ejector 120 includes a plurality of scrapers 123, which are provided on a rotating shaft 121 while being spaced apart from each other by a predetermined distance in order to discharge the ice pieces from each ice making cell 112.

A heater 130 is installed below the ice making tray 110. The heater 130 heats the bottom surface of the ice making tray 110 such that the ice pieces can be easily separated from the ice making cells 112 by the ejector 120.

The heater 130 may include an electric heating medium that generates heat upon receiving electric power or the like. The heater 130 heats the bottom surface of the ice making tray 110 before the ejector 120 is operated, so that the ice pieces can be easily separated from the ice making tray 110 by the ejector 120.

A tray cover 150 is installed in front of the ice making tray 110. The tray cover 150 includes an ice guide 151 for guiding the ice pieces discharged by the ejector 120 into the ice storage container 60 and a level protector 153 for protecting an ice detection lever 140. The lever protector 153 is formed with perforation holes 154 to allow cold air to pass therethrough.

A water dispense cup 200 is provided at one side of the ice making tray 110 to dispense water to the ice making cells 112. A water supply pipe 160 is installed above the water dispense cup 200. The water supply pipe 160 extends from the refrigerator body 10 to the storage compartment door 30 and an end portion of the water supply pipe 160 is exposed out of the storage compartment door 30 and extends into the water dispense cup 200.

Figure 3:
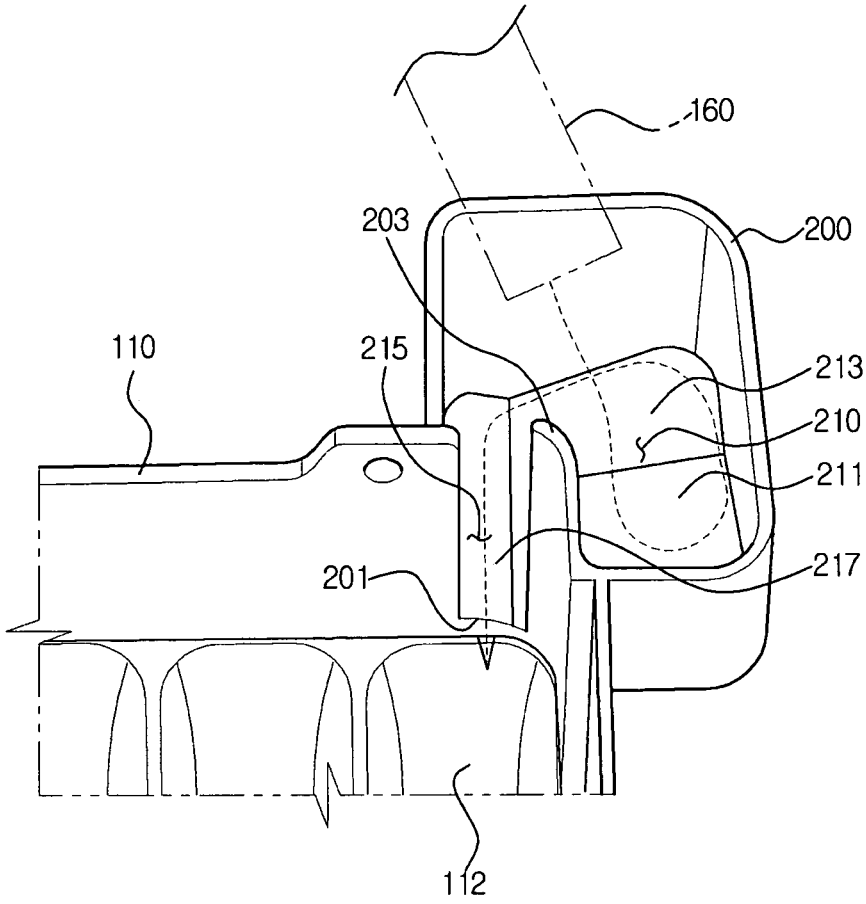
FIG. 3 is an enlarged perspective view showing a water dispense cup of an ice maker according to an exemplary embodiment of the present invention.
Figure 4:
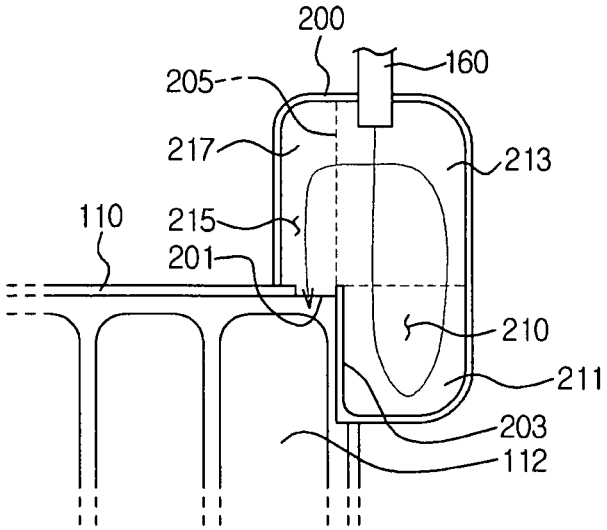
FIG. 4 is a plan view showing a water dispense cup of an ice maker according to an exemplary embodiment of the present invention.
Figure 5:
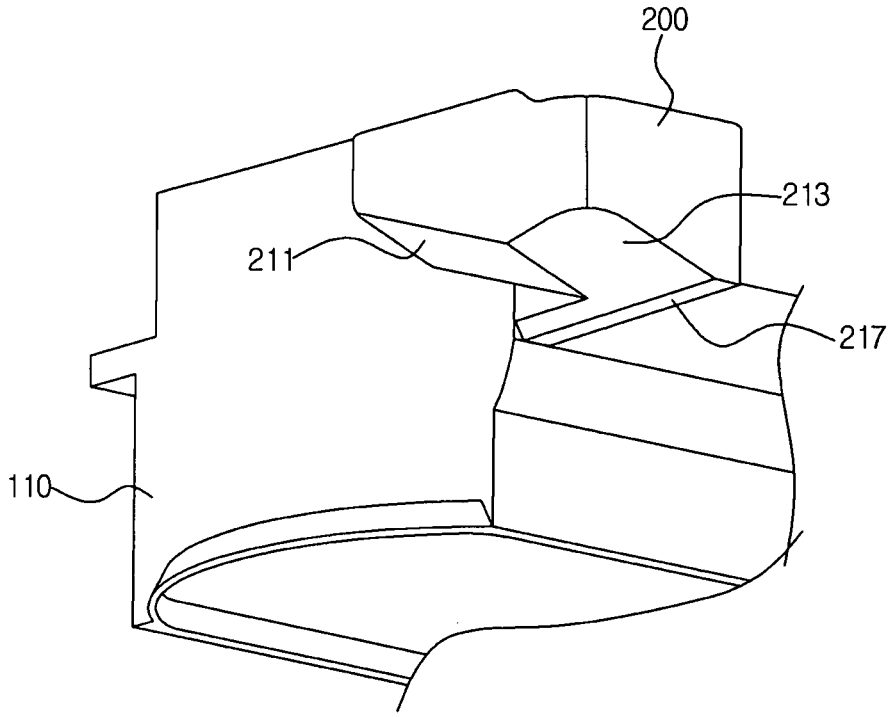
FIG. 5 is a perspective view showing a lower portion of a water dispense cup of an ice maker according to an exemplary embodiment of the present invention.

Referring to FIGS. 3 to 5, the water dispense cup 200 has a substantially box shape and is integrally formed with the ice making tray 110 at the upper edge portion of one side wall of the ice making tray 110. In addition, the water dispense cup 200 is made from aluminum, which is identical to the material for the ice making tray 110, such that heat generated from the heater 130 installed between the ice making tray 110 can be easily transferred to the water dispense cup 200. The water dispense cup 200 prevents water discharged from the water supply pipe 160 from being splashed in various directions. Water remaining in the tip of the water supply pipe 160 may be dropped into the water dispense cup 200 so that ice may be formed in the water dispense cup 200 after the water has been supplied into the ice maker 100. However, according to the present invention, heat of the heater 130 is transferred to the water dispense cup 200 so that the ice formed in the water dispense cup 200 can be melted.

Figure 6:
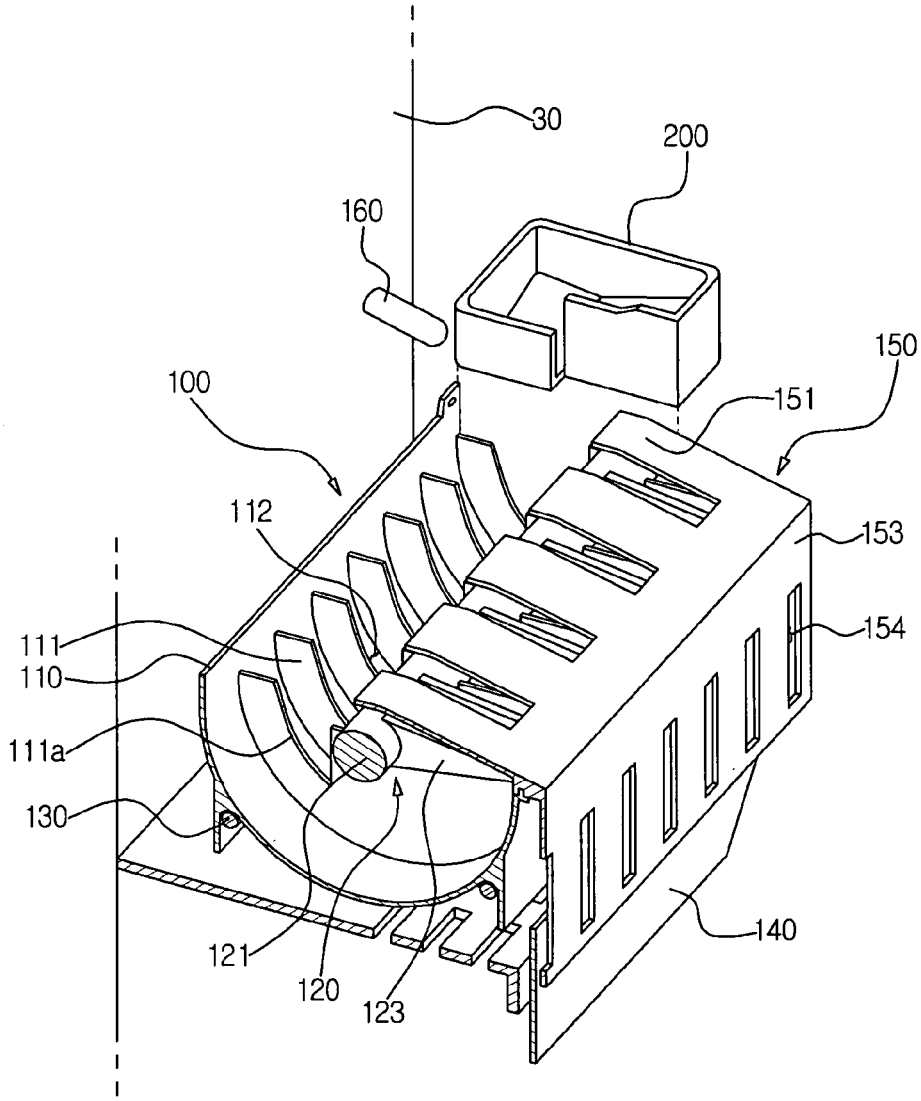
FIG. 6 is a perspective view schematically showing an ice maker according to another exemplary embodiment of the present invention.

According to an exemplary embodiment of the present invention, the water dispense cup 200 is integrally formed with the ice making tray 110. However, the present invention is not limited thereto. According to another exemplary embodiment of the present invention, as shown in FIG. 6, the ice making tray 110 can be prepared separately from the water dispense cup 200. In this case, the ice making tray 110 is coupled with the water dispense cup 200 by using a coupling member (not shown).

An upper surface of the water dispense cup 200 is open to receive the water from the water supply pipe 160. In addition, a cavity is formed in the water dispense cup 200 to temporarily store the water supplied from the water supply pipe 160 and a water outlet port 201 is formed at one side of the water dispense cup 200. The water outlet port 201 communicates with the ice making cells 112 such that the water contained in the water dispense cup 200 can be introduced into the ice making cells 112. According to an exemplary embodiment of the present invention, the water outlet port 201 is formed at a rear portion of the ice making tray 110. However, the present invention is not limited thereto. According to another exemplary embodiment of the present invention, the water outlet port 201 can be formed at a lateral portion or a front portion of the ice making tray 110.

A partition wall 203 is provided in the water dispense cup 200 to prevent water supplied from the water supply pipe 160 from being directly introduced into the water outlet port 201. That is, the partition wall 203 includes a water guide section 210 that extends from one sidewall of the water dispense cup 200, which is opposite to the water supply pipe 160, toward the water supply pipe 160 to guide the water supplied from the water supply pipe 160 into a region located below the tip of the water supply pipe 160, and a water discharge section 215 for discharging the water supplied from the water guide section 210 toward the water outlet port 201. A communication path 205 is provided between the water guide section 210 and the water discharge section 215.

The bottom surface of the water dispense cup 200 is inclined such that the water supplied from the water supply pipe 160 can be completely introduced into the ice making cells 112.

That is, the water guide section 210 includes a first inclination surface 211, which is inclined toward the rear portion of the water dispense cup 200 such that the water supplied from the water supply pipe 160 can be guided toward the region below the water supply pipe 160, and a second inclination surface 213, which is inclined from the right to the left of the water dispense cup 200 such that the water introduced through the first inclination surface 211 can be directed toward the communication path 205. In addition, the water discharge section 215 includes a third inclination surface 217, which is inclined from the rear portion of the water dispense cup 200 toward the water outlet port 201 such that the water introduced through the second inclination surface 213 can be directed toward the water outlet port 201. Therefore, the water supplied from the water supply pipe 160 may flow through the first to third inclination surfaces 211, 213 and 217 formed at the bottom surface of the water dispense cup 200, so that the water may not be collected in the water dispense cup 200.

In addition, the water supply pipe 160, which extends into the water dispense cup 200, is located above the second inclination surface 213 of the water dispense cup 200. In this case, even if the water remaining in the tip of the water supply pipe 160 is dropped onto the second inclination surface 213 of the water dispense cup 200 after the water has been supplied to the ice maker 100, the water may flow to the water outlet port 201 through the second and third inclination surfaces 213 and 217. In addition, even if the second inclination surface 213 is frozen due to the cold air, since the water supplied from the water supply pipe 160 is introduced into the second inclination surface 213 through the first inclination surface 213, ice or pieces of ice accumulated on the second inclination surface 213 can be discharged together with the water, so that ice or pieces of ice can be prevented from being accumulated in the water dispense cup 200.

Figure 7:
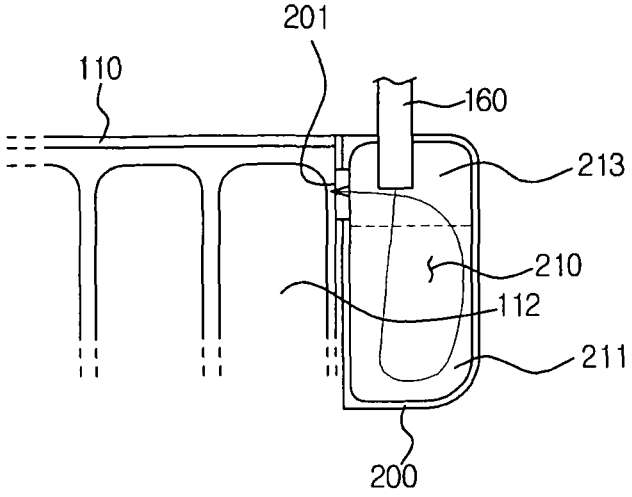
FIG. 7 is a plan view showing a water dispense cup according to another exemplary embodiment of the present invention.

FIG. 7 shows a water dispense cup coupled with the ice making tray according to another exemplary embodiment of the present invention.

As shown in FIG. 7, the water outlet port 201 of the water dispense cup 200 is formed at the lateral side of the ice making tray 110.

The water dispense cup 200 is fabricated through an injection molding process by using plastic material and is coupled to the lateral side of the ice making tray 110. In addition, the water dispense cup 200 can be made from metal having superior heat conductivity and can be integrally formed with the ice making tray 110.

Only the water guide section 210 is formed in the water dispense cup 200 to guide the water supplied from the water supply pipe 160 to the water outlet port 201.

The water guide section 210 includes a first inclination surface 211, which is inclined from the front portion to the rear portion of the water dispense cup 200 to guide the water supplied from the water supply pipe 160 toward the region below the water supply pipe 160, and a second inclination surface 213, which is inclined from the right to the left of the water dispense cup 200 such that the water introduced through the first inclination surface 211 can be directed to the water outlet port 201 formed at the lateral side of the water dispense cup 200.

The water supply pipe 160 is located above the second inclination surface 213 in adjacent to the left part of the water dispense cup 200. Thus, as indicated by an arrow, the water supplied from the water supply pipe 160 flows along the right part of the first inclination surface 211. Then, the water flows from the right part to the left part of the second inclination surface 213, so that ice or ice pieces formed on the water dispense cup 200 due to the water dropped onto the water dispense cup 200 from the water supply pipe 160 can be discharged together with the water. Thus, ice or ice pieces can be prevented from being accumulated in the water dispense cup 200.

Although few exemplary embodiments of the present invention have been shown and described, it would be appreciated by those skilled in the art that changes may be made in these exemplary embodiments without departing from the principles and spirit of the invention, the scope of which is defined in the claims and their equivalents.

What is claimed is:

1. A refrigerator comprising:

a storage compartment;

a storage compartment door to open/close the storage compartment; and an ice maker including an ice making tray to produce ice pieces, and a water dispense cup having a water outlet port to dispense water supplied from a water supply pipe to the ice making tray, wherein the water dispense cup includes a water guide section formed within the water dispense cup and configured to guide the water, which is supplied from the water supply pipe, to make a U-turn within the water guide section before flowing to a water discharge section below the water supply pipe, for discharging the water supplied from the water guide section toward the water outlet port, and wherein the water guide section includes a first inclination surface, which is inclined to guide the water supplied from the water supply pipe toward the water discharge section below the water supply pipe, a second inclination surface, which is inclined to allow the water introduced through the first inclination surface to be directed toward a communication path, and third inclination surface, which is inclined from a rear portion of the water dispense cup toward the water outlet port of the water dispense cup to allow water supplied to the second inclination surface to be directed toward the water outlet port of the water dispense cup.

2. The refrigerator as claimed in claim 1, wherein the ice maker further includes a heater to heat the ice making tray.

3. The refrigerator as claimed in claim 1, wherein the ice making tray and the water dispense cup are made of metal material, wherein the ice maker further includes a heater to heat the ice making tray and the water dispense cup.

4. The refrigerator as claimed in claim 1, wherein the ice making tray is integrally formed with the water dispense cup, wherein the ice maker further includes a heater to heat the ice making tray and the water dispense cup made of metal material.

5. The refrigerator as claimed in claim 2, wherein the ice maker heats the water dispense cup by using heat of the heater that is operated when ice pieces are separated from the ice making tray.

6. The refrigerator as claimed in claim 1, wherein a partition wall is provided in the water dispense cup to partition an inner space of the water dispense cup into the water guide section and the water discharge section.

7. An ice maker comprising:

an ice making tray for producing ice pieces; and a water dispense cup having a water outlet port to dispense water to the ice making tray, wherein a partition wall is provided in the water dispense cup to prevent water supplied from a water supply pipe from being directly introduced into a water outlet port of the water dispense cup, wherein the water dispense cup includes a water guide section formed within the water dispense cup and configured to guide the water, which is supplied from the water supply pipe, to make a U-turn within the water guide section before flowing to a water discharge section below the water supply pipe, for discharging the water supplied from the water guide section toward the water outlet port, and wherein the water guide section includes a first inclination surface, which is inclined to guide the water supplied from the water supply pipe toward the water discharge section below the water supply pipe, a second inclination surface, which is inclined to allow the water introduced through the first inclination surface to be directed toward a communication path, and third inclination surface, which is inclined from a rear portion of the water dispense cup toward the water outlet port of the water dispense cup to allow water supplied to the second inclination surface to be directed toward the water outlet port of the water dispense cup.

8. The ice maker as claimed in claim 7, further comprising a heater to heat the ice making tray.

9. The ice maker as claimed in claim 8, wherein the ice maker heats the water dispense cup by using heat of the heater that is operated when ice pieces are separated from the ice making tray.

10. The ice maker as claimed in claim 7, wherein the ice making tray and the water dispense cup are made of a metal material and the ice making tray is integrally formed with the water dispense cup, wherein the ice maker further includes a heater to heat the ice making tray and the water dispense cup.

11. A refrigerator comprising:

a storage compartment;

a storage compartment door to open/close the storage compartment;

a water supply pipe protruding from the storage compartment door; and an ice maker including an ice making tray including metal having superior heat conductivity, a heater to heat the ice making tray, and a water dispense cup having a water outlet port to dispense water supplied from the water supply pipe to the ice making tray, wherein a partition wall is provided in the water dispense cup to prevent water supplied from the water supply pipe from being directly introduced into a water outlet port of the water dispense cup, wherein the water dispense cup is made of a metal material, wherein the water dispense cup includes a water guide section formed within the water dispense cup and configured to guide the water, which is supplied from the water supply pipe, to make a U-turn within the water guide section before flowing to a water discharge section below the water supply pipe, for discharging the water supplied from the water guide section toward the water outlet port, and wherein the water guide section includes a first inclination surface, which is inclined to guide the water supplied from the water supply pipe toward the water discharge section below the water supply pipe, a second inclination surface, which is inclined to allow the water introduced through the first inclination surface to be directed toward a communication path, and third inclination surface, which is inclined from a rear portion of the water dispense cup toward the water outlet port of the water dispense cup to allow water supplied to the second inclination surface to be directed toward the water outlet port of the water dispense cup.

12. The refrigerator as claimed in claim 11, wherein the ice making tray is integrally formed with the water dispense cup.

* * * * *